United States Patent [19]

Wood

[11] 4,311,217

[45] Jan. 19, 1982

[54] DESCENT CONTROL UNIT

[75] Inventor: Kenneth H. Wood, Brighton, Australia

[73] Assignee: Moxham Industrial Pty., Ltd., South Melbourne, Australia

[21] Appl. No.: 106,164

[22] Filed: Dec. 21, 1979

[30] Foreign Application Priority Data

Dec. 29, 1978 [AU] Australia ..... PD7237

[51] Int. Cl.[3] ..... B65H 59/16

[52] U.S. Cl. ..... 188/65.2; 182/5

[58] Field of Search ..... 188/65.1, 65.2, 65.4, 188/65.5; 182/5, 7, 193, 241

[56] References Cited

U.S. PATENT DOCUMENTS

| | | | |
|---|---|---|---|
| 386,237 | 7/1888 | Budd | 188/65.4 |
| 493,391 | 3/1893 | Sturtevant | 188/65.5 |
| 3,250,515 | 5/1966 | Hadnall et al. | 182/5 |
| 3,695,397 | 10/1972 | Hobbs | 188/65.4 |
| 4,077,094 | 3/1978 | Swager | 182/5 |

*Primary Examiner*—Edward R. Kazenske

*Attorney, Agent, or Firm*—Scully, Scott, Murphy & Presser

[57] ABSTRACT

The invention relates to a descent control unit of the kind used for lowering an injured person on a rope. The unit consists essentially of bar around which the rope is wound and a gate arrangement which is hinged to one end of the bar and is detachably secured to the other end of the bar by a locking pin. The bar and gate thus combine to form, in use, a closed loop through which the rope passes. The gate arrangement is formed so as to have a hook which extends beyond the other end of the bar to facilitate a lifting operation using the free end of the rope and a groove is provided in the gate arrangement to guide the free end and facilitate control of the descent rate. A snap hook on the gate provides for connection of the unit to a harness on the injured person and the snap hook is provided with an arm which extends across the groove to retain the rope therein when the unit is under load.

3 Claims, 3 Drawing Figures

DESCENT CONTROL UNIT

Figure 1:
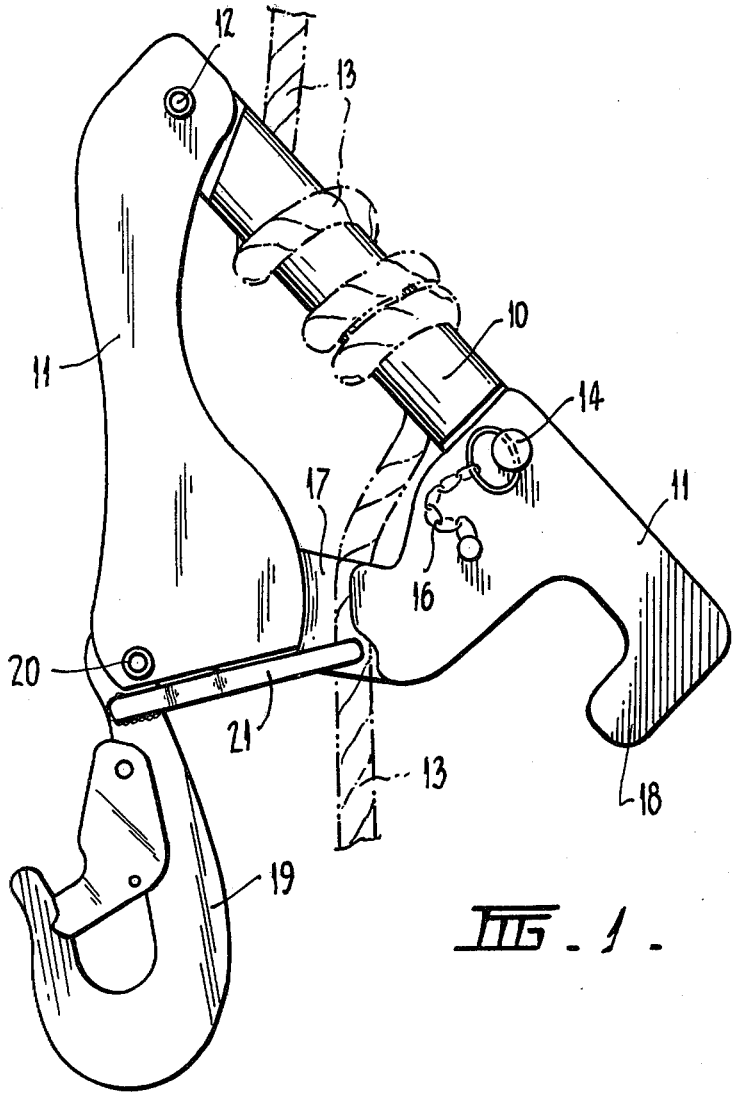

This invention relates to a descent control unit of the kind used, for example, to support an injured person on a rope during a lowering procedure in a manner whereby the rate of descent on the rope may be controlled.

Devices of the above kind are known and generally rely on friction of the rope around a friction bar to provide the control of descent rate. One such device is marketed in the U.S.A. under the trade mark Skygenie and consists essentially of a friction bar in the form of a rod of circular section having a diametrically extending hole therethrough at each end. The rope is inserted through the hole at one end, is wound around the bar two or three times and is then passed through the hole at the other end. A hook on one end of the bar connects to a harness on the user and enables the user to be suspended from the device. The rate of descent on the rope may be controlled by varying the angle of exit of the free end of the rope from the device. Such a device suffers the disadvantage that it is necessary to use an end of the rope when connecting the device thereto and this is not always convenient in use.

A further problem which arises when using known devices occurs in the many instances when it is necessary to rescue an unconscious or disabled person who has become entangled in a structure such as, for example, a ladder. Before lowering the injured person to the ground it is usually necessary to lift the person slightly to enable limbs to be readily disentangled from the ladder without the risk of causing further injury. The known devices make no provision for assisting in this difficult lifting task.

Accordingly it is an object of the present invention to provide a descent control device or unit which obviates at least one of the aforementioned problems.

Thus the invention provides a descent control unit including a friction bar around which a rope may be wound, gate means hinged to one end of said bar and adapted to releasably close onto the other end of said bar so as to co-operate therewith to provide an enclosed loop, locking means associated with said bar and said gate means to lock said bar gate means in the closed condition, said gate means providing a groove adapted, in use, to receive said rope for the purpose of guiding downwardly extending free rope from said unit and facilitating control of descent rate, and hook means pivotally connected to said gate means and adapted to attach said unit to a support on a person to be lowered, said hook means having an arm member thereon and being located in a position such that, in use, under the weight of said person said hook means assumes a position wherein said arm member bridges said groove to prevent the rope from becoming removed.

According to a further broad form the invention provides a descent control unit including a friction bar around which a rope may be wound, gate means hinged to one end of said bar and adapted to releasably close onto the other end of said bar so as to co-operate therewith to provide an enclosed loop, locking means associated with said bar and said gate means to lock said bar and gate means in the closed condition, said gate means providing a groove adapted, in use, to receive said rope for the purpose of guiding downwardly extending free rope from said unit and facilitating control of descent rate, and hook means pivotally connected to said gate means and adapted to attach said unit to a support on a person to be lowered, said gate means including further hook means whereby said person may be lifted by looping said free rope upwardly over a support, downwardly around said further hook means and over said support again such that, by pulling on said free end, the resultant mechanical advantage readily facilitates said lifting over a short distance.

Figure 2:
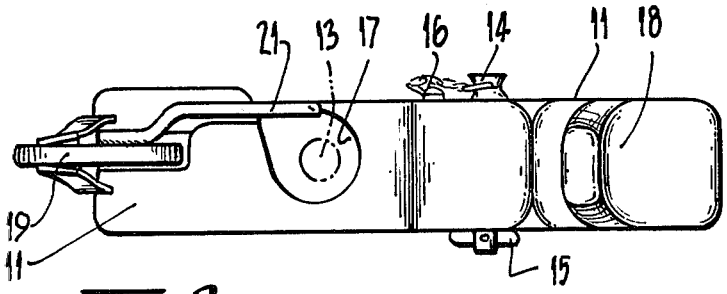
Figure 3:
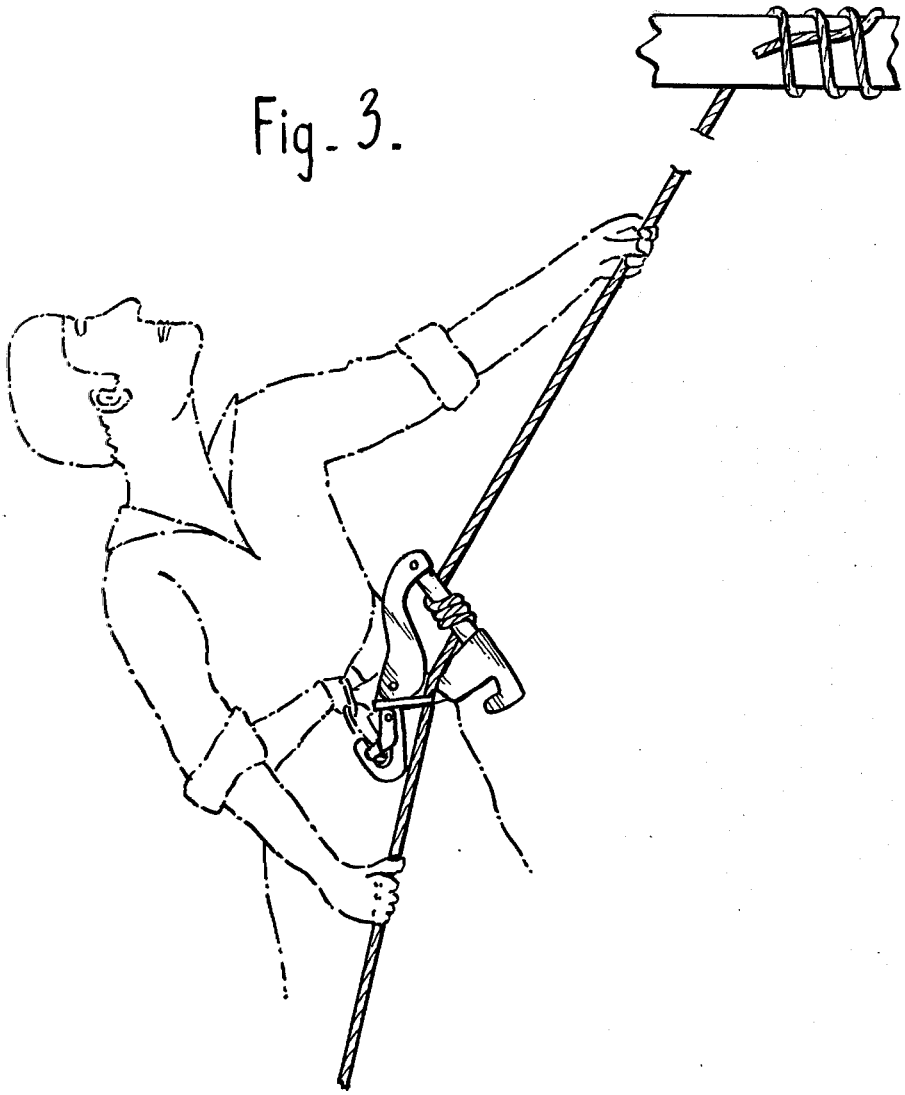

In order that the invention may be more readily understood one particular embodiment will now be described with reference to the accompanying drawings wherein FIG. 1 is a side elevation of a unit according to the invention shown in position on a rope;

FIG. 2 is an underside view of the unit of FIG. 1; and FIG. 3 is a perspective view of the descent control unit as attached to an injured person.

Referring now to the drawings the unit is shown to consist essentially of a friction bar 10 of circular cross-section formed from steel, and a cast metal gate member 11 which is pivotally connected to one end of the bar 10 by means of a pin 12. The bar 10 is arranged with parallel flat sides at each end to facilitate the pivotal connection with the gate member 11 and to facilitate engagement with the gate member at the other end thereof. Thus the friction bar 10 and gate member 11 co-operate to provide, in a closed position, an enclosed loop through which rope 13 may be passed. The gate member 11 is retained in a closed position with the bar 10 by means of a locking pin 14. The locking pin passes through the gate member 11 and bar 10 and is retained in position by a pivotal locking flap 15. The locking pin 14 is resiliently located in the gate member 11 by means of a spring (not shown) which enables the pin 14 to be pressed inwardly to release the locking flap 15. The pin 14 is retained on the gate member 11 by means of a chain 16.

The gate member 11 is shaped so as to provide a groove 17 through which the rope 13 may slide in use as well as a hook member 18 for the purpose of facilitating a lifting operation as will become apparent hereinbelow. The groove 17 and hook member 18 are cast integrally with the gate member 11.

A snap hook 19 is pivotally connected to the gate member 11 by means of a further pin 20 and is adapted to connect to a belt, harness, or the like which is arranged on the person to be supported by the unit. As shown in FIG. 3 the unit is attached to the harness which constitutes a support on a person to be lowered, as well as an upper support beam to which the upper end of the rope 13 is attached in a secure manner.

The snap hook 19 has an arm member 21 welded thereto as shown in the drawings. The arm member 21 is arranged such that when the unit is in use in position as shown in FIG. 1 the arm member 21 extends across the top of groove 17 so as to prevent the rope 13 from disengaging the groove. Thus the rope 13 is retained in position in the groove at all times when the unit is in use.

It will be apparent from the description hereinabove that the descent control unit of the present invention is readily attached to a rope in use, merely by opening the gate member 11 after removing locking pin 14 whereby the rope may be wound around the friction bar 10 two, three or more times depending on the required rate of descent. Once the rope has been wound around the friction bar 10 the gate member 11 may be closed to provide a loop through which the rope passes. It will be evident that the unit may be arranged anywhere along the length of rope 13 as it is not necessary to have an end of the rope in order to attach the unit. The free or downwardly extending end of the rope 13 is arranged in groove 17 and facilitates control of the descent rate. In order to control the descent rate either the tension in the downwardly extending free end of rope 13 is altered by a rescuer or the angle of exit of rope 13 from groove 17 is altered from a vertical position towards a horizontal position at the point of exit. Either way the effect is to alter the descent rate. Control of descent rate is preferably effected by a person standing on the ground below the person being lowered but in some instances a rescuer who has climbed up to attach the unit to the injured person also effects the descent control. Once in use and supporting the weight of a person on hook 19 the arm member 21 closes the groove 17 to prevent the rope from escaping.

In many rescue operations it is necessary to remove an injured and perhaps unconscious person who has become entangled in some form of structure. For this purpose it is necessary to initially provide a slight lifting function in order that limbs may be disentangled from the structure. For this purpose the free or downwardly extending end of rope 13, or a portion of the free rope immediately below the unit is looped over any suitable structure above the injured person, is brought downwardly around said hook member 18 and is taken again over the support structure. Thus by pulling on the free end of rope 13 the resultant mechanical advantage facilitates lifting of the person as the hook member 18, and hence the unit, is raised a short distance. Once the entangled limbs are free the rope may be disengaged from the support structure and hook 18 and a controlled rate of descent may be effected in a manner as described above. It will be evident that the unit of the present invention provides the utmost degree of safety in that the rope cannot be disengaged from the unit or from the control facilitated by groove 17 and thus once an injured person is connected to the unit by means of hook 19 it is impossible to become disconnected in the course of the lowering procedure. The invention thus provides advantages over the prior art devices as described above.

I claim:

1. A descent control unit including a friction bar around which a rope may be wound, gate means hinged to one end of said bar and adapted to releasably close onto the other end of said bar so as to co-operate therewith to provide an enclosed loop, locking means associated with said bar and said gate means to lock said bar and gate means in the closed condition, said gate means providing a groove adapted, in use, to receive said rope for the purpose of guiding downwardly extending free rope from said unit and facilitating control of descent rate, and hook means pivotally connected to said gate means and adapted to attach said unit to a support on a person to be lowered, said hook means having an arm member thereon and being located in a position such that, in use, under the weight of said person said hook means assumes a position wherein said arm member bridges said groove to prevent the rope from becoming removed.

2. A descent control unit as defined in claim 1 wherein said gate means includes further hook means whereby said person may be lifted by looping said free rope upwardly over a support, downwardly around said further hook means and over said support again such that, by pulling on said free end, the resultant mechanical advantage readily facilitates said lifting over a short distance.

3. A descent control unit as defined in claim 2 wherein said further hook means comprises a hook formed integrally with said gate means, said gate means comprising a generally U-shaped gate.

* * * * *